US006780118B1

(12) United States Patent
McCartney

(10) Patent No.: US 6,780,118 B1
(45) Date of Patent: Aug. 24, 2004

(54) GOLF SWING TRAINING DEVICE

(75) Inventor: Kelly McCartney, Sharon, PA (US)

(73) Assignee: K-Netic Golf Company, Vienna, OH (US)

( * ) Notice: Subject to any disclaimer, the term of this patent is extended or adjusted under 35 U.S.C. 154(b) by 0 days.

(21) Appl. No.: 10/389,589

(22) Filed: Mar. 17, 2003

(51) Int. Cl.[7] ..... A63B 69/36
(52) U.S. Cl. ..... 473/219; 473/314
(58) Field of Search ..... 473/219, 256, 473/226, 314; 482/109

(56) References Cited

U.S. PATENT DOCUMENTS

| | | | | | |
|---|---|---|---|---|---|
| 2,146,048 | A | * | 2/1939 | Barnhart | 473/323 |
| 3,351,346 | A | * | 11/1967 | Strahan | 473/256 |
| 4,511,147 | A | | 4/1985 | Olsen | |
| 4,592,552 | A | | 6/1986 | Garber | |
| 4,826,168 | A | * | 5/1989 | McGuire et al. | 473/295 |
| 5,167,415 | A | * | 12/1992 | Iandola | 473/256 |
| 5,184,819 | A | * | 2/1993 | Desbiolles | 473/309 |
| 5,582,407 | A | | 12/1996 | Sorenson | |
| 5,785,608 | A | | 7/1998 | Collins | |
| 5,989,131 | A | | 11/1999 | Burkholder | |
| 6,186,904 | B1 | * | 2/2001 | Bass | 473/256 |
| 6,190,266 | B1 | * | 2/2001 | Pamias | 473/294 |
| 6,379,261 | B1 | * | 4/2002 | Hart | 473/292 |
| 2002/0132678 | A1 | * | 9/2002 | Matzie | 473/203 |
| 2003/0050130 | A1 | * | 3/2003 | Wade | 473/287 |
| 2003/0190971 | A1 | * | 10/2003 | Rohan-Weaver | 473/219 |

* cited by examiner

*Primary Examiner*—Raleigh W. Chiu
(74) *Attorney, Agent, or Firm*—Harpman & Harpman

(57) ABSTRACT

An invention directed towards golf swing training devices to improve a golfer's swing by repetitive practice swing. The device emulates a golf club having an upper head grip portion and a simulated club head portion on the oppositely disposed end thereof. The training device shaft is of a solid monolithic construction that includes a trans-axially offset portion extending from adjacent the club head portion to a point approximately one-third the overall length of the device returning to a longitudinal axis of the shaft. The offset shaft portion imparts a forward weight mass displacement in combination with an axially oriented alignment between the club head and the shaft to naturally rotate the golfer's hands and release to simulate the correct swing mechanism for improved play.

7 Claims, 5 Drawing Sheets

GOLF SWING TRAINING DEVICE

BACKGROUND OF THE INVENTION

1. Technical Field

This invention relates to golf swing training aides that by repetitive use improves the golfer's swing by imparting the correct swing mechanics to the user.

2. Description of Prior Art

Prior art devices of this type have relied on a variety of club head and shaft configurations to change the effective weight distribution and thus improve the golfer's swing by forcing the user to emulate the correct mechanical actions associated with a "proper swing". Some prior art devices disclose offset club shafts and weighted heads, see for example U.S. Pat. Nos. 4,511,147, 4,529,552, 5,785,608, 5,582,407, and 5,989,131.

In U.S. Pat. No. 4,511,147 a golf swing training club is disclosed in which a weighted head is formed from the shaft material itself and is positioned outwardly and above a head center point.

U.S. Pat. No. 4,592,552 is directed towards a golf putter utilizing an offset club head.

U.S. Pat. No. 5,785,608 illustrates a golf club putter with a contoured rearwardly positioned offset shaft interconnection.

A golf swing trainer device is illustrated in U.S. Pat. No. 5,582,407 in which a solid straight shaft is used having a hand grip on one end.

U.S. Pat. No. 5,989,131 discloses a golf weight training device to improve a golfer's swing comprising an elongated shaft with a curved end portion.

SUMMARY OF THE INVENTION

A swing training device for improving a golfer's swing by repetitive practice swings using the training device. The device simulates a proper golf swing utilizing an elongated solid shaft with a contoured top hand grip portion and a bottom club head portion having an elongated offset portion formed from the shaft defining an axially offset forward mass distribution and axially rotation in relation to the face of the club head portion imparting an improved swing action to the user by repetitive use.

DESCRIPTION OF THE PREFERRED EMBODIMENT

Figure 1:
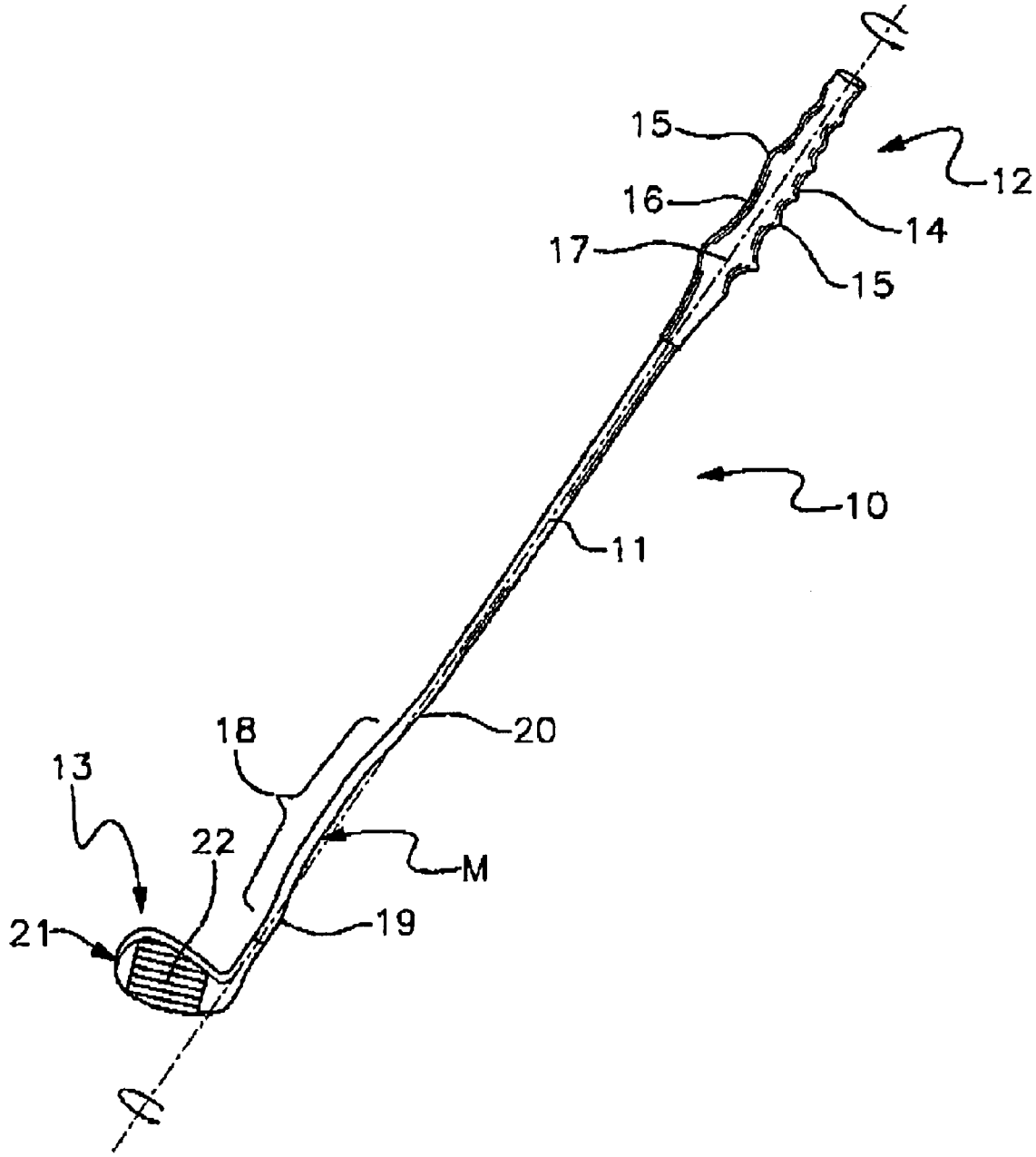
FIG. 1 is a side elevational view of the golf swing training device.

Referring to FIG. 1 of the drawings, a golf training swing device 10 of the invention can be seen having an elongated solid shaft 11 of metallic material with a hand grip portion 12 on one end and a head portion 13 in oppositely disposed relation thereto. The grip portion 12 has a hand grip 14 with a plurality of contoured surface ridges 15 and intermediate recess areas 16 there between to provide a proper grip receiving surface 17 for a golfer's hands H to be closed there about. A correct grip is important to the use of the swing training device 10 of the invention so that a comfortable level can be achieved with minimal muscle tension and good inter-reaction development during the swing.

The solid shaft 11 extends from the grip portion 12 to the head portion 13 on a generally linear axis with an axially offset longitudinal portion 18 extending from a first transition point at 19 adjacent the head portion 13 to a second transitional point 20 in spaced relation to the hand grip portion 12.

Figure 4:
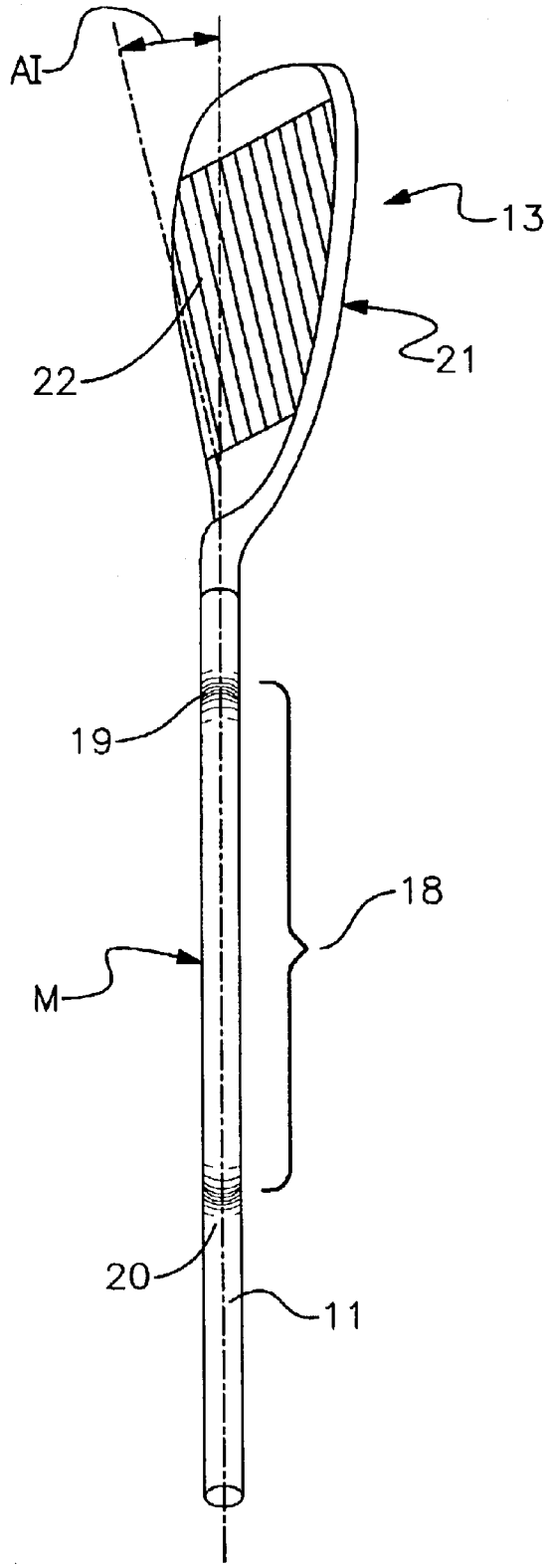
FIG. 4 is an enlarged perspective view illustrating the axial rotation offset angle between the club face and the longitudinal axis of the shaft and elongated offset portion thereof.

The head portion 13 is defined by a club head 21 of a typical head configuration. Referring to FIG. 4 of the drawings, the orientation of the club head 21 is illustrated in which a club face 22 alignment is angularly offset in relation to the axial offset longitudinal portion 18 by the attachment of the club head 21 to the shaft 11. The rotational angular inclination is typically between 5% and 15% deviation as indicated at Al depending on the design of the club head 21 used. As will be evident to those skilled in the art, the "club face" 22 alignment will vary in relation to the type of golf club head being simulated and thus account for the variation in degree of rotational angular offset orientation of the club face alignment with that of the hereinbefore described longitudinal shaft portion 18.

Figure 7:
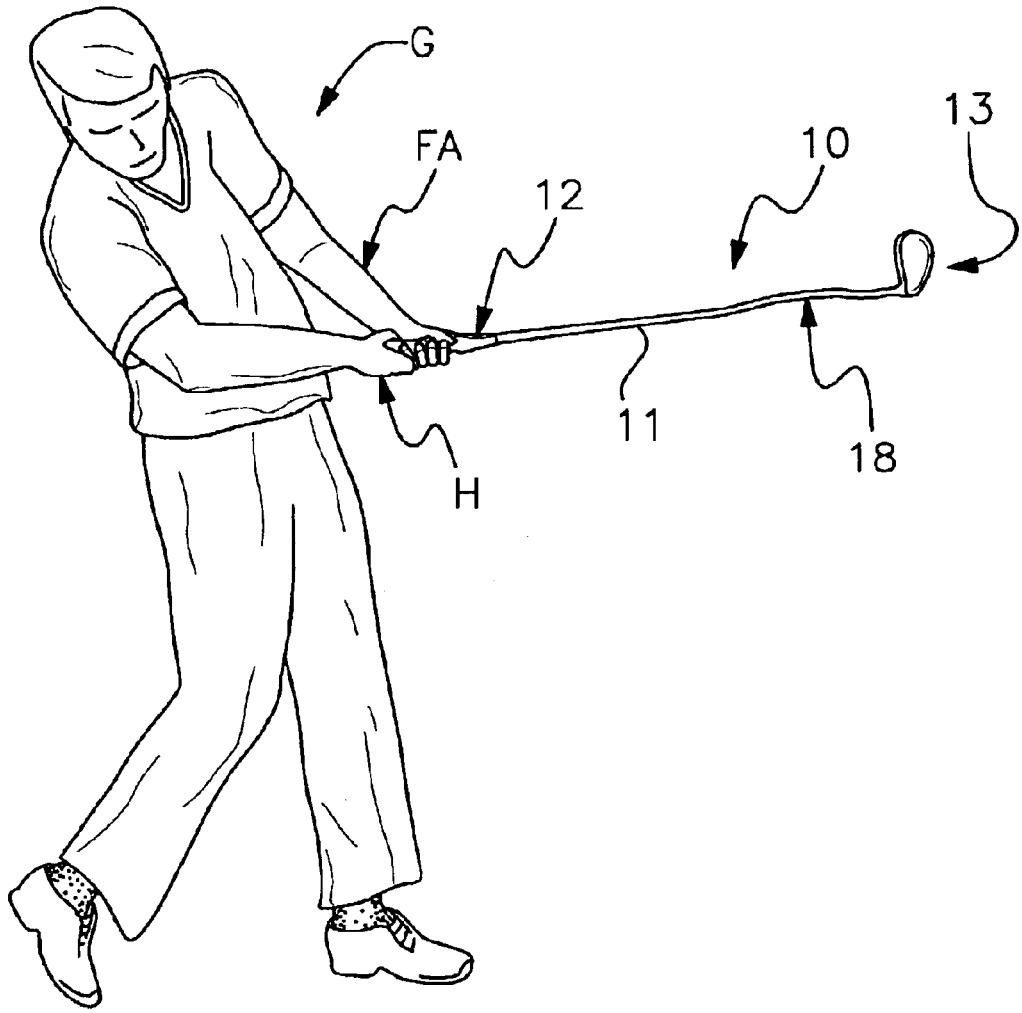
FIG. 7 is a perspective view showing the completed and follow-through of the practice swing utilizing the device of the invention.

It is important to note that in use the offset portion 18 of the shaft 11 due to the club face's orientation hereinbefore described will "trail" the club head during the swing thus the mass re-orientation will tend to urge the player's hands H to roll over in an axial rotation at the perceived point of ball contact due to the rotational torque developed by the offset mass nature of the shaft portion 18 in combination with the club head mass defining the angular rotational orientation there between as generally indicated in the follow through in FIG. 7 of the drawings.

Figure 2:
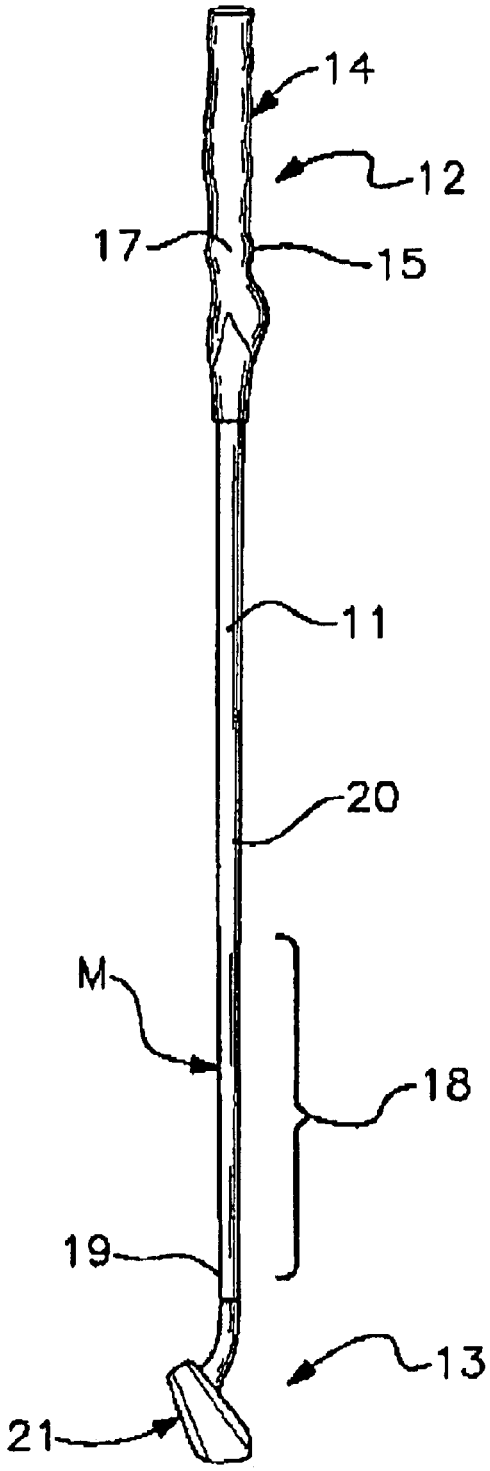
FIG. 2 is a front elevational view thereof.
Figure 3:
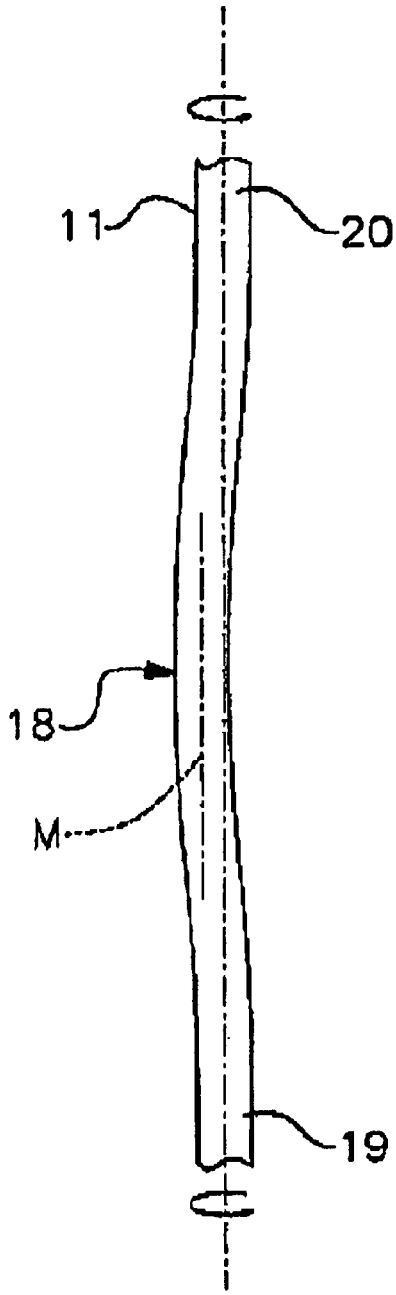
FIG. 3 is an enlarged partial side elevational view of the offset portion of the device.

Referring back to FIGS. 1 and 2 of the drawings, the swing training device 10's unique swing training characteristics are evident in which the mass M of the offset shaft portion 18 is concentrated adjacent the club head portion 21 so as to be placed in spaced relation to the hand grip 14. This orientation and proportional length of the offset area 18 along with the axial rotational angular inclination between the offset area 18 and the club face 22 due to its offset mass M is critical to the performance of the device as hereinbefore described.

Figure 6:
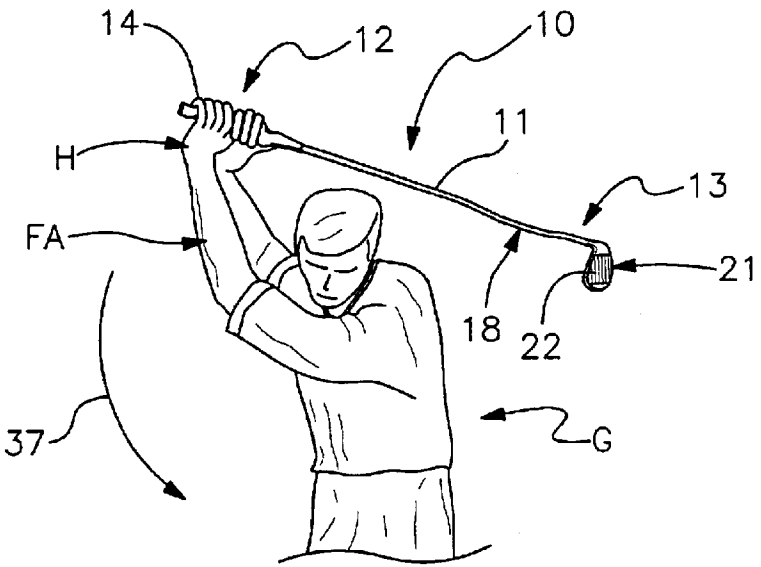
FIG. 6 is a partial perspective view illustrating the top portion of a practice swing with the invention.
Figure 5:
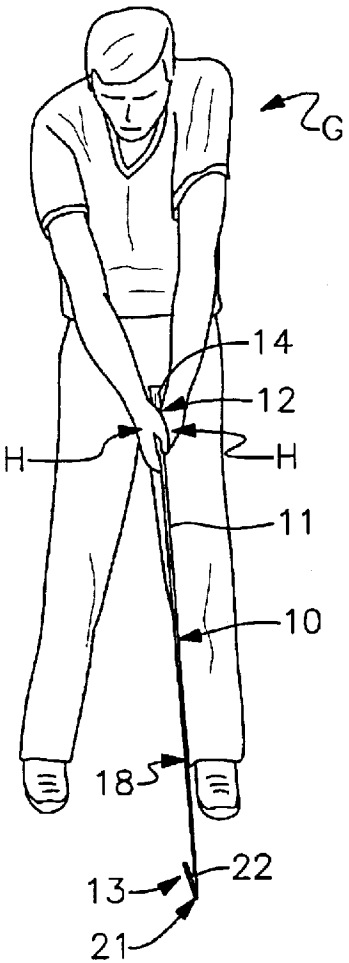
FIG. 5 is a perspective view illustrating the manner of use of the invention.

Referring now to FIGS. 5–7 of the drawings, the use of the swing training device 10 can be seen in which the user representation G (golfer) assumes a "address the ball position" in FIG. 5 of the drawings. As the user G swings the training swing device back for a practice swing as seen in FIG. 6 of the drawings, the top of the swing is illustrated. On the down swing as indicated by swing arrows 37, the user G's forearms FA are extended and the user's hands H are gently rotated through the simulated ball impact due to the offset mass as noted, encouraging the rolling of the user's hands as seen generally in FIG. 7 of the drawings with the follow through.

The offset mass of the device 10 derived from the positioning of the offset curved shaft portion 18 in longitudinally spaced relation to that of the hand grip 14 and the axial rotation angular displacement between the longitudinal axis orientation of the shaft portion 18 in a vertical orientation and that of the club face 22 forces the user G to develop a consistent swing by the properly turning of the "rotating" hands at impact through the "ball" during actual golf play. Since it is important during actual play with conventional golf clubs (not shown) that the clubs strike the ball (not shown) squarely and not be influenced by the natural tendency of the user associated with play. The hands H and wrists will be urged to rotate axially on the longitudinal axis thereof so as not to cause an "open" or "closed" affective club face as will be known and understood by those skilled in the art. To address these issues, the swing trainer 10 is designed to "swing through" thus imparting a natural feel to the practice swings. The swing through action is achieved by the relationship of the respective curvilinear nature of the offset shaft portion 18 in combination with the forward mass of the club head 21 and its orientation alignment therewith.

It will be evident from the above description that the user can use the swing training device 10 of the invention at any time either before, during or after play to achieve a balanced and well defined golf swing for improved play. It will thus be seen that a new and useful swing training device has been illustrated and described and that various changes and modifications may be made without departing from the spirit of the invention.

Therefore I claim:

1. A golf swing training device for imparting a proper golf swing comprises, an elongated solid shaft having a substantially straight longitudinal center axis, a grip portion on the upper end of said shaft, a swing head portion on the lower oppositely disposed end of said shaft, a longitudinal axial offset portion defining a curvilinear surface extending from adjacent said swing head portion defining shaft transition point, a second shaft transition point in aligned longitudinal spaced relation to said swing head portion and said grip portion, an intermediate shaft portion extending between and interconnecting said first transition point in said swing head portion and an intermediate shaft portion extending between the interconnecting said second transition point and said grip portion said swing head portion in axial rotational angular inclination to said longitudinal axial offset portion of said shaft.

2. The golf swing training device set forth in claim 1 wherein said swing head portion comprises a simulated club head having a club alignment face defining a club face orientation alignment line.

3. The golf swing training device set forth in claim 2 wherein said orientation alignment line of said club face in axial angular offset alignment in relation to said longitudinal axial offset portion's vertical alignment and said shaft.

4. The golf swing training device set forth in claim 1 wherein said grip portion comprises; a contoured hand grip on said shaft extending inwardly from one end of the shaft.

5. The golf swing training device set forth in claim 1 wherein said solid shaft is made of metallic material.

6. The golf swing training device set forth in claim 1 wherein said longitudinal axial offset portion is transversely offset from said longitudinal axial aligned intermediate shaft portion adjacent thereto.

7. The golf swing training device set forth in claim 1 wherein said longitudinal axial offset curvilinear grated surface and said swing head portion defines a mass distribution forward of said grip portion and said remaining shaft portion imparting an axial rotation of said shaft and attached hand grip portion at and beyond a simulated point of ball contact within the swing.

* * * * *